US011344178B2

(12) United States Patent
Kim et al.

(10) Patent No.: US 11,344,178 B2
(45) Date of Patent: May 31, 2022

(54) DISHWASHER

(71) Applicant: LG Electronics Inc., Seoul (KR)

(72) Inventors: Jinhong Kim, Seoul (KR); Minehul Kim, Seoul (KR); Kyuhyung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 31 days.

(21) Appl. No.: 17/088,268

(22) Filed: Nov. 3, 2020

(65) Prior Publication Data

US 2021/0045615 A1 Feb. 18, 2021

Related U.S. Application Data

(63) Continuation of application No. 15/741,856, filed as application No. PCT/KR2016/007424 on Jul. 8, 2016, now Pat. No. 11,026,556.

(30) Foreign Application Priority Data

Jul. 21, 2015 (KR) ..... 10-2015-0103108
Jan. 5, 2016 (KR) ..... 10-2016-0000983

(51) Int. Cl.
*A47L 15/42* (2006.01)

(52) U.S. Cl.
CPC ..... *A47L 15/4206* (2013.01); *A47L 15/4246* (2013.01)

(58) Field of Classification Search
CPC ..... A47L 15/4206
See application file for complete search history.

(56) References Cited

U.S. PATENT DOCUMENTS

| | | | |
|---|---|---|---|
| 2010/0037923 | A1 | 2/2010 | Dingier et al. |
| 2010/0252080 | A1 | 10/2010 | Yoon et al. |
| 2013/0032178 | A1 | 2/2013 | Gnadinger et al. |
| 2015/0000714 | A1 | 1/2015 | Yoo et al. |

FOREIGN PATENT DOCUMENTS

| | | |
|---|---|---|
| CN | 202096176 | 1/2012 |
| CN | 202446037 | 9/2012 |
| EP | 0752231 | 1/1997 |
| EP | 0855165 | 7/1998 |
| GB | 1202546 | 8/1970 |

(Continued)

OTHER PUBLICATIONS

Extended European Search Report in European Application No. 20183896.8, dated Nov. 10, 2020, 11 pages.

(Continued)

*Primary Examiner* — Jason Y Ko
(74) *Attorney, Agent, or Firm* — Fish & Richardson P.C.

(57) ABSTRACT

Disclosed is a dishwasher comprising a tub defining a washing space, a sump provided to collect the wash water injected into the tub, a supply pump provided to supply the wash water stored in the sump to the tub, a filter provided in the sump and comprising a first body having a plurality of first holes formed along a lateral circumferential surface; and a second body arranged in a radially inner side of the first body and having a plurality of second holes formed along a lateral circumferential surface, wherein the second body comprises an external wall portion in which the second holes are formed and an internal wall portion positioned in a radially inner side of the external wall and vertically extended.

18 Claims, 15 Drawing Sheets

(56) References Cited

FOREIGN PATENT DOCUMENTS

| | | |
|---|---|---|
| KR | 101241871 | 7/2007 |
| KR | 100856782 | 9/2008 |
| KR | 1020100110547 | 10/2010 |
| KR | 1020110058050 | 6/2011 |
| KR | 1020120129266 | 11/2012 |
| WO | WO2012085840 | 6/2012 |

OTHER PUBLICATIONS

Office Action in Korean Appln. No. 10-2015-0103108, dated Jul. 27, 2021, 12 pages (with English translation).
Extended European Search Report in European Appln. No. 16827966.9, dated Feb. 21, 2019, 8 pages.
PCT International Search Report and Written Opinion in International Appln. No. PCT/KR2016/007424, dated Oct. 19, 2016, 15 pages.

DISHWASHER

CROSS REFERENCE TO RELATED APPLICATIONS

This application is a continuation of U.S. application Ser. No. 15/741,856, filed on Jan. 4, 2018, now allowed, which is the National Phase of International Application No. PCT/KR2016/007424, filed on Jul. 8, 2016, which claims priority under 35 U.S.C. 119(a) to Korean Application Nos. 10-2015-0103108, filed on Jul. 21, 2015 and 10-2016-0000983, filed on Jan. 5, 2016, which are hereby incorporated by reference herein in their entirety.

TECHNICAL FIELD

Embodiments of the present disclosure relate to a dishwasher, more particularly, to a dishwasher including a filter device configured to facilitate flow of wash water and filter stick-shaped foreign substances at the same time.

BACKGROUND ART

Dishwashers are apparatuses configured to remove food scraps which remains on dishes or cooking tools (hereinafter, washing objects) using wash water.

Typically, a dishwasher includes a tub defining a washing space, a rack provided in the tub and accommodating washing objects, an injection arm injecting washing water to the rack, a sump in which the washing water is stored, and a pump supplying the wash water stored in the sump to the injection arm.

As one of such a dishwasher, Korean Patent No. 10-2011-004578 (hereinafter, the conventional dishwasher) discloses a filter device provided in the dishwasher.

The conventional dishwasher consists of a first filter including holes having preset sizes provided there around and a second filter having a mesh member provided there around.

Wash water passes through the first filter and the second filter to be drained. If they are stacked in the first and second filters, foreign substances block the filters and interferes in the flow of wash water.

Especially, stick-shaped foreign substances (for example, a toothpick) are likely to pass through the filter device toward a drainage path. The stick-shaped foreign substance having passed the filter device might block the drainage path only to interfere in the drainage of wash water.

In the conventional dishwasher, the filter device is detachably installed in a sump cover provided in a top surface of the sump. When foreign substances are stacked in the filter device, a user has to demount the filter device from the sump cover and remove the foreign substances to reuse.

However, the conventional dishwasher has no auxiliary handle for the filter device and the disadvantage that the user has to hold the filter device stacked with foreign substances.

Moreover, when the filter device provided in the conventional dishwasher is detached from the sump cover, a foreign-substance plate provided in the sump cover is detached together and the foreign-substance plate is caught in the injection arm. Accordingly, it is difficult to detach the filter device and the foreign-substance plate from the sump cover.

The conventional dishwasher has a disadvantage that the stick-shaped foreign substances introduced into the filter device might damage the sump, the pump or internal walls of the filter device.

SUMMARY

To overcome the disadvantages, an object of the present disclosure is to provide a dishwasher including a filter device which is able to filter foreign substances with various sizes efficiently.

Another object of the present disclosure is to provide a dishwasher including a filter device which is able to filter stick-shaped foreign substances efficiently.

Another object of the present disclosure is to provide a dishwasher including a filter device which is able to prevent a drainage path from getting blocked by stick-shaped foreign substances.

Another object of the present disclosure is to provide a dishwasher including a filter device which is able to allow a user to detach a filter device from a sump smoothly.

To achieve these objects and other advantages and in accordance with the purpose of the embodiments, as embodied and broadly described herein, a dishwasher comprises a tub defining a washing space; a sump provided to collect the wash water injected into the tub; a supply pump provided to supply the wash water stored in the sump to the tub; and a filter provided in the sump and comprising a first body having a plurality of first holes formed along a lateral circumferential surface; and a second body arranged in a radially inner side of the first body and having a plurality of second holes formed along a lateral circumferential surface, wherein the second body comprises an external wall portion in which the second holes are formed and an internal wall portion positioned in a radially inner side of the external wall and vertically extended.

At this time, the internal wall portion may be extended downwards farther than a lower end of the external wall portion.

A plurality of ribs may protrude radially outward from the lateral circumferential surface of the internal wall portion.

The plurality of the ribs may be extended from an outer lateral surface of the internal wall portion to an inner lateral surface of the external wall portion.

Each of the ribs may shut off the path along a circumferential direction of the space formed between the internal wall portion and the external wall portion.

Each of the ribs may comprise a rib top arranged in a position corresponding to the inner circumferential surface of the external wall portion and a rib bottom extended from a lower end of the rib top downwards.

The width of the projected area formed in the rib bottom may be larger than that of the projected area formed in the rib top.

The length of the rib top may be equal to that of the rib bottom.

The second body may be dome-shaped and comprises a flat portion provided in a top, and the plurality of the second holes may be formed in a lateral circumferential surface of the second body, except the flat portion.

The plurality of the ribs may be extended from the overall longitudinal area of the internal wall portion.

The plurality of the ribs may be spaced a preset distance apart from each other along a lateral circumferential surface of the internal wall portion.

A mesh member may be provided under the first body.

A connection portion for connecting the first body and the second body with each other may be provided between the between an outer bottom circumference of the second body and an inner circumference of the first body.

The connection portion may be configured to prevent washing water from getting into the filter device through the space formed between the first body and the second body.

A penetrating hole may be formed in a top surface of the sump, and an inclined portion inclined toward the penetrating hole provided in the top surface of the sump, and a predetermined area of the filter device may be inserted in the penetrating hole.

A filter installation sheet may be formed along the penetrating hole, and a top side of the filter device may be exposed above the filter installation sheet, when the filter device is installed in the penetrating hole.

The first body and the second body may be exposed above the filter installation sheet.

The shape of the first hole may be different from that of the second hole.

The first hole may be larger than the second hole.

The first body and the second body may be integrally formed with each other in a method of injection molding.

The dishwasher may further comprises one or more racks provided in the tub and accommodating one or more washing objects; and one or more injection arms formed to inject the wash water supplied by the supply pump toward the one or more racks.

The dishwasher may further comprise a sump cover partitioning off the tub from the sump and allowing the sub to communicate with the sump; and a support portion detachably secured to the communication hole and comprising a penetrating hole, wherein the first body further comprises a handle arranged across a top surface of the first body.

The first body may be detachably secured to the filter device.

The filter device may comprise a holder portion held to an outer circumferential surface of the penetrating hole and supporting the first body; a support rib extended from the holder portion downwards and to which the mesh member is coupled; and a supporter provided in a lower end of the support rib and keeping a uniform shape of the mesh member.

One or more protrusions may be projected from the support rib, and the one or more protrusions taken out to the support portion may be caught by the support portion and the support portion is taken out from the communication hole, together with the filter device.

The internal wall portion may comprise a first internal wall body extended vertically with respect to the holder portion; and a second internal wall body extended from a lower end of the first internal wall body in an inner circumferential surface of the holder portion 21, forming a step with the first internal wall body.

An insert hole may be provided in the holder portion, and the first body may further comprise an extended rib extended therefrom downwards and inserted in the insert hole.

At this time, the extended rib may comprise a hook coupled to the insert hole.

The dishwasher hook may comprise an inclined surface inclinedly projected from one end of the extended rib; and a hook surface extended from one end of the inclined surface to a surface of the extended rib.

The extended rib may further comprise a fixing portion projected a preset length along one surface of the extended rib and spaced apart from the hook, and the fixing portion may keep a uniform distance between the top surface of the first body and the holder portion when the extended rib is inserted in the insert hole.

When the extended rib is inserted in the insert hole, a lower surface of the fixing portion may contact with an upper surface of the holder portion and an upper surface of the hook surface may contact with a lower surface of the holder portion.

The second body may further comprise a plurality of projected ribs extended along a circumferential direction of the holder portion upwards; and a coupling ring connecting the plurality of the projected ribs with each other, and the first body further comprises an extended rib extended downwards and coupled to the coupling ring, and the extended rib may comprise a hook projected from one end of the extended rib and detachably coupled to the coupling ring.

The extended rib may further comprise a fixing portion projected a preset length along one surface of the extended rib and spaced apart from the hook. When the hook is coupled to the coupling ring, a lower surface of the fixing portion may contact with an upper surface of the coupling ring and the hook contacts with a lower surface of the holder portion.

The hook may comprise a first hook provided in a side of one end of the extended rib; and a second hook provided in the other side of the end, spaced from the first hook as far as the thickness of the projected rib, and the projected rib may be inserted between the first hook and the second hook.

A fixing groove accommodating the projected rib may be provided in the fixing portion, and when the projected rib is inserted between the first hook and the second hook, one end of the projected rib may be inserted in the fixing groove.

A fastening unit may be projected from the supporter downwards, and a screw unit may be provided in the sump. When a user rotates the handle in a state where the filter device is inserted in the sump, the fastening portion may be fastened to or unfastened from the screw unit.

The first body may further comprise a guide rib extended from the handle downwards, and a guide hole guiding the first body may be provided in a top surface of the second body.

The support portion may be formed as a mesh type so as to filter the foreign substances drawn into the communication hole.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

The embodiments have following advantageous effects. The dishwasher in accordance with the present disclosure may include the filter device which is able to filter foreign substances with various sizes efficiently.

The dishwasher may include the filter device which is able to filter stick-shaped foreign substances efficiently.

The dishwasher may include the filter device which is able to prevent a drainage path from getting blocked by stick-shaped foreign substances.

The dishwasher may include the filter device which is able to allow a user to detach a filter device from a sump smoothly.

The dishwasher may include the filter device the user is able to take out from the sump, together with the support portion supporting the filter device.

The dishwasher may include the filter device which the user is able to take out together with the support portion without interfering in internal components of the tub.

BRIEF DESCRIPTION OF THE DRAWINGS

The present invention will become more fully understood from the detailed description given herein below and the accompanying drawings, which are given by illustration only, and thus are not limitative of the present invention, and wherein.

DETAILED DESCRIPTION

Referring to the accompanying drawings, a system interworking between a cooking apparatus and a kitchen device in according to one embodiment of the present disclosure will be described in detail. Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

Figure 1:
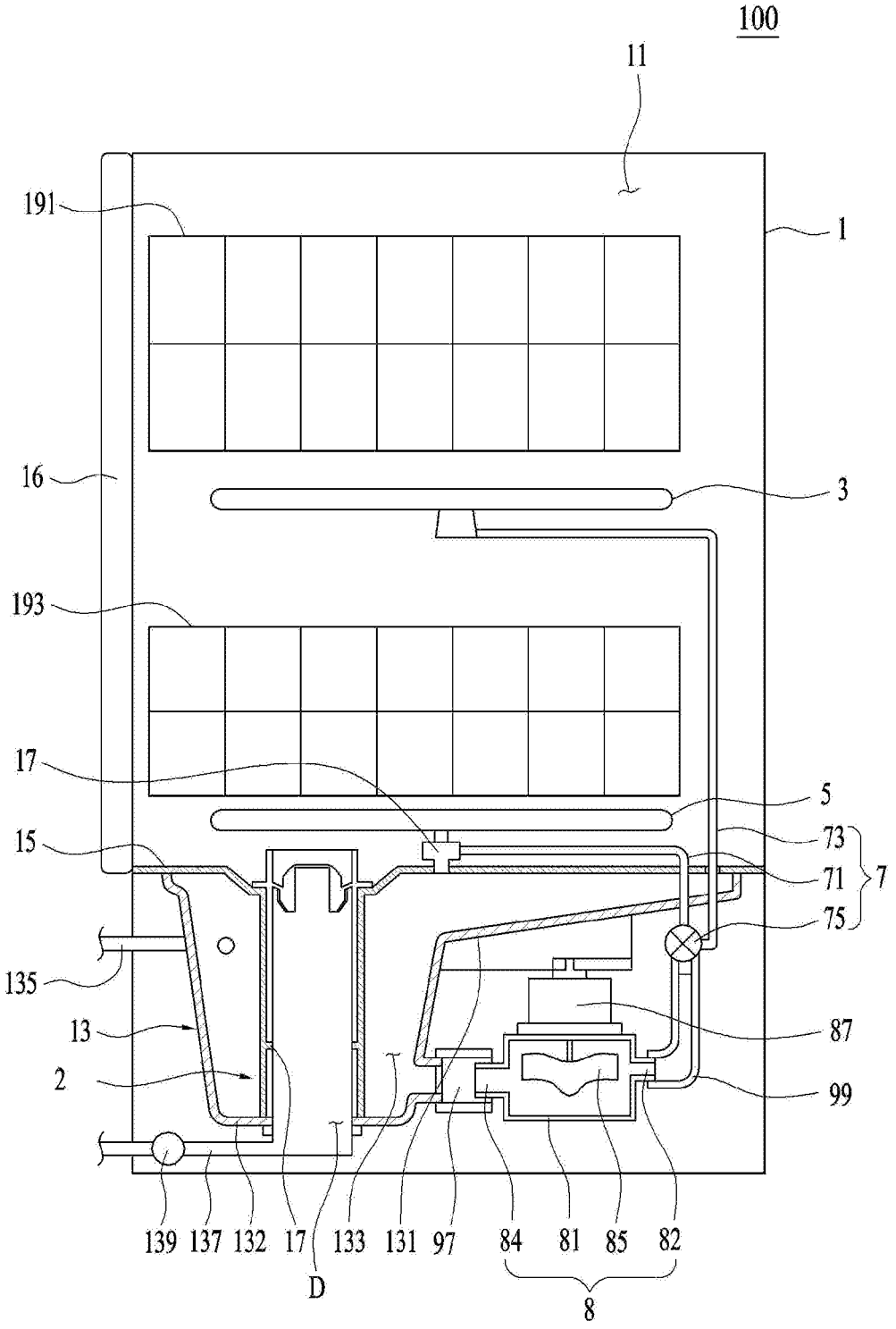
FIG. 1 is a sectional diagram illustrating a dishwasher in accordance with one embodiment of the present disclosure.

FIG. 1 is a sectional diagram illustrating a dishwasher in accordance with one embodiment of the present disclosure.

Referring to FIG. 1, the dishwasher 100 in accordance with the illustrated embodiment includes a cabinet 1, a tub 11 defining a washing space, one or more racks 191 and 194 providing some space in which washing objects are accommodated, one or more injection arm 3 and 5 injecting washing water, a sump 13 providing a space in which washing water is stored, a supply pump 8 providing the washing water stored in the sump 13 to the one or more injection arms 3 and 5, and a filter device 2 insertedly installed in the sump 13.

The cabinet 1 defines an external appearance of the dishwasher 100 and a door 16 may be coupled to the cabinet 1 to open and close the tub 11.

The tub 11 may be provided in the cabinet and provides certain space for washing one or more washing objects. The tub 11 may be provided over the sump 13.

The one or more racks 191 and 193 may include a first rack 191 and a second rack 193 arranged under the first rack 191. The first and second racks 191 and 193 may be referred to as upper and lower racks, respectively.

The upper rack 191 and the lower rack 193 may be drawn from the cabinet 1 when the door 16 opens the tub 11.

In other words, one or more rails (not shown) may be provided in an inner circumferential surface of the tub 11 to guide the moving of the one or more racks 191 and 193 toward the door 16. A roller (not shown) may be provided in and supported by the rack 191 or 193.

The one or more injection arms 3 and 5 may include an upper arm 5 provided in the tub 11 and injecting washing water toward the washing object accommodated by the second rack 193; and an upper arm 3 injecting washing water toward the washing object accommodated by the first rack 191.

The lower arm 5 and the upper arm 3 may be supplied washing water via the supply pump 8 and a supply path 7. The supply path 7 may include a first supply path 71 connected to the lower arm 5, a second supply path 73 connected to the upper arm 3, and a transfer valve selectively opening the supply paths 71 and 73.

When the lower arm 5 is rotatably provided in the tub 11, the lower arm 5 is rotatably secured to a holder 17 provided in the sump cover 15. The first supply path 71 is provided to supply washing water to the holder 17.

If it is rotatably provided in the tub 11, the upper arm 3 may be rotatably secured to one end of the second supply path 73.

The sump 13 may be configured to collect the washing water injected into the tub 11 and store the collected washing water.

In addition, the sump 13 may include a storage 133 for storing the washing water, a sump cover 15 located in a top of the storage 133 to partition off the storage 133 from the tub 11, a side portion 131 connecting the storage 133 to the sump cover 15, and a bottom portion provided as a lower surface of the sump 13. At this time, the sump cover 15 may form a top surface of the sump cover 13.

The storage 133 may be structured to be supplied the washing water via a water supply path 135 connected to a water supply source (not shown). In other words, the water supply path 135 connected to the water supply source.

The supply pump 8 may be formed to supply the washing water stored in the sump 13 to the sub 11. Specifically, the supply pump 8 may be configured to inject the washing water stored in the sump 13 into the tub 11 via the injection arm 3 and 5.

Specifically, the supply pump 8 may include a housing 81 having an impeller 85, an inject hole 84 for supplying the washing water to the housing 81, an outlet hole 82 for exhausting the washing water from the housing 81, and a motor 87 provided in an outside of the housing 81 to rotate the impeller 85.

The inlet hole 84 may be connected to the storage 133 via an inlet hole connection pipe 97 and the outlet hole 82 may be connected to the transfer valve 74 via an outlet hole connection pipe 99.

When the motor 87 provided with electricity rotates the impeller 85, the water supplied to the housing 81 from the sump 13 may flow to the transfer valve 75 via the outlet hole 82 and the water supplied to the transfer valve 75 may flow to the upper arm 3 or the lower arm 5 along the supply paths 71 and 73 selectively opened by the transfer valve 75.

The sump 13 includes the sump cover 15 partitioning off the sump 13 from the tub 11 and a communication hole 14 may be provided in the sump cover 15 to allow the tub 11 to communicate with an inside of the sump 13.

The filter device 2 is inserted in the communication hole 14 so as to filter foreign substances from the washing water drawn into the sump 13.

Meanwhile, the structure of the filter device 2 is likely to affect the circulation and drainage of washing water, which will be described later referring to FIGS. 4 through 9.

Figure 2:
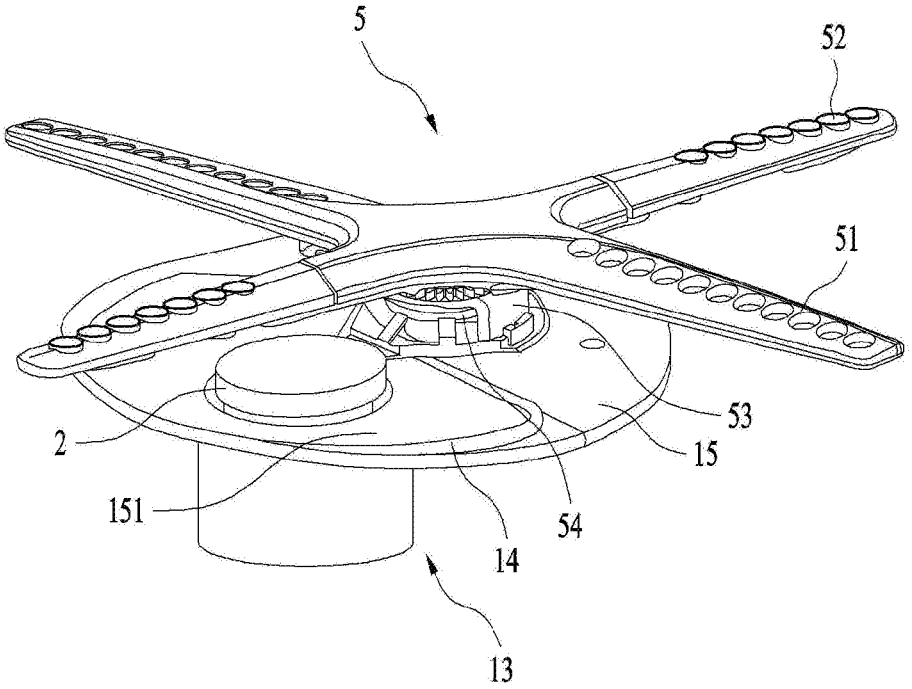
FIG. 2 is a perspective diagram illustrating an internal structure of a tub.
Figure 3:
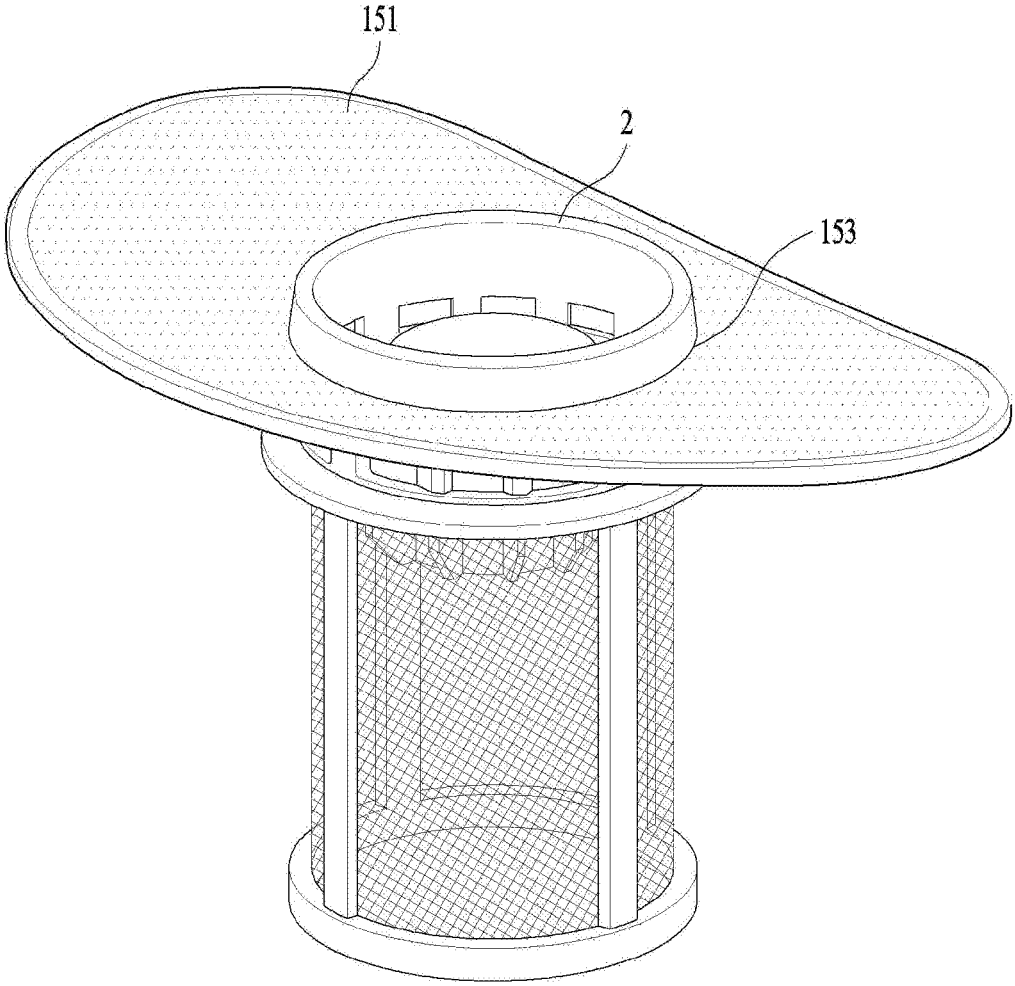
FIG. 3 is a perspective diagram illustrating a schematic configuration of a filter device shown in FIG. 2.

FIG. 2 is a perspective diagram illustrating the internal structure of the tub. FIG. 3 is a perspective diagram illustrating the schematic configuration of the filter device shown in FIG. 2.

Referring to FIG. 2, the sump 13 may include a sump cover 15 provided as a top surface of the sump 13, a communication hole 14 provided in the sump cover 15, in communication with the internal space of the sump 13, and a support portion 151 inserted in an inner circumferential surface of the communication hole 14 to be a part of the sump cover 15. The lower arm 5 may be provided in a central area of the sump cover 15.

The lower arm 5 is detachably secured to the sump cover 15 and injects the washing water stored in the sump 13 toward the washing objects placed in the racks 191 and 193. The lower arm 5 may include the injection arms 51 and 52 for injecting washing water and a fixing gear 53 and an arm holder 54 secured to the sump cover 15 to rotatably support the injection arms 51 and 52.

Washing water flows to the lower arm 5 and then is injected via the injection arms 51 and 52 toward the washing objects.

The support portion 151 may is provided as a predetermined part of the sump cover 15 and inserted in the communication hole 14. For example, the support portion 151 may be made of a mesh member so that the washing water can flow into the communication hole 153 by the support portion 151 and return to the sump 13.

The support portion 151 may include a penetrating hole 153 formed therein and the filter device 2 may be inserted in the penetrating hole 153 to filter and remove the foreign substances contained in the washing water returning to the sump 13 via the communication hole 14. In other words, the filter device 2 may be insertedly secured to the sump 13 through the penetrating hole 153.

Meanwhile, the filter device 2 may be detachably secured to the sump 13 so that the user can detach the filter device 2 from the sump 13 to remove the filtered foreign substances and re-secure it to the sump 13. That will be described later referring to FIGS. 10 through 16C.

Referring to FIG. 3, the filter device 2 is inserted in the sump 13 and certain area of the filter device 2 is exposed on the support portion 151. Accordingly, the user holds some area of the filter device 2 and takes out the filter device 2 from the sump 13.

However, foreign substances are likely to remain on the exposed area of the filter device 2 and stuck on an inner circumferential surface of the penetrating hole 153 formed in the support portion 151. When the user detach or take out the filter device 2 from the support portion or the communication hole 14, foreign substances gets on the user's hand.

In addition, even when trying to detach the filter device 2 from the sump 13, the user has to rotate the exposed area of the filter device and needs quite a strong grip, which will be also described later referring to FIGS. 10 through 16C.

Hereinafter, the process of filtering stick-shaped foreign substances such as toothpicks, using the filter device 2, is described in detail.

Figure 4:
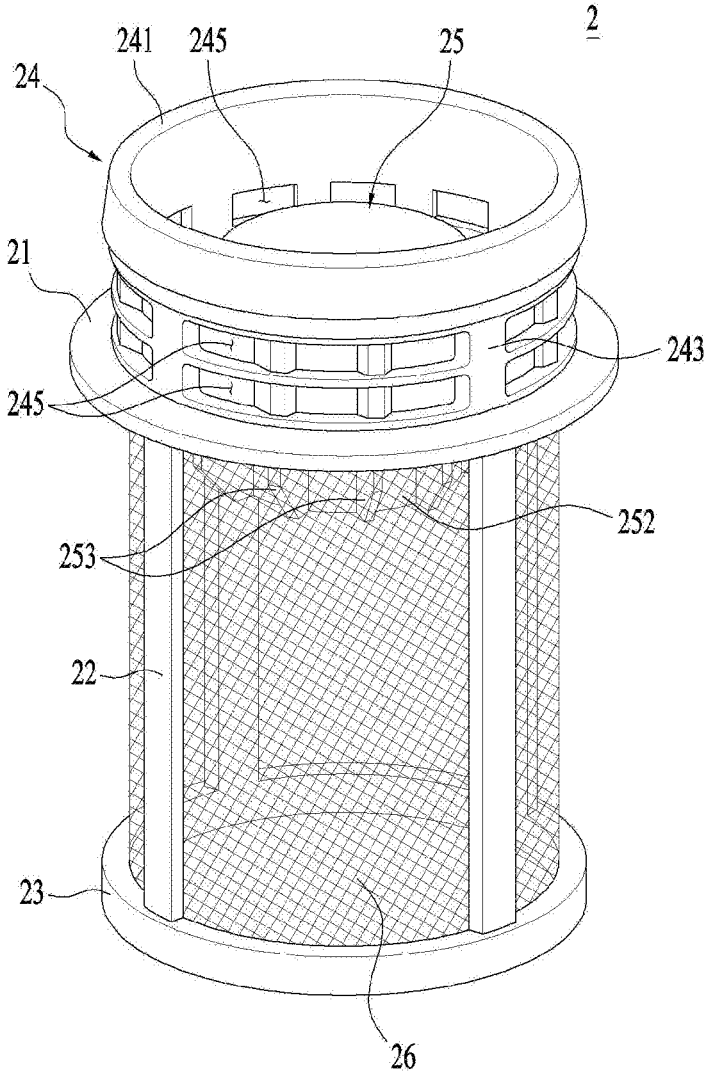
FIG. 4 is a perspective diagram illustrating a filter device in accordance with one embodiment of the present disclosure.
Figure 5:
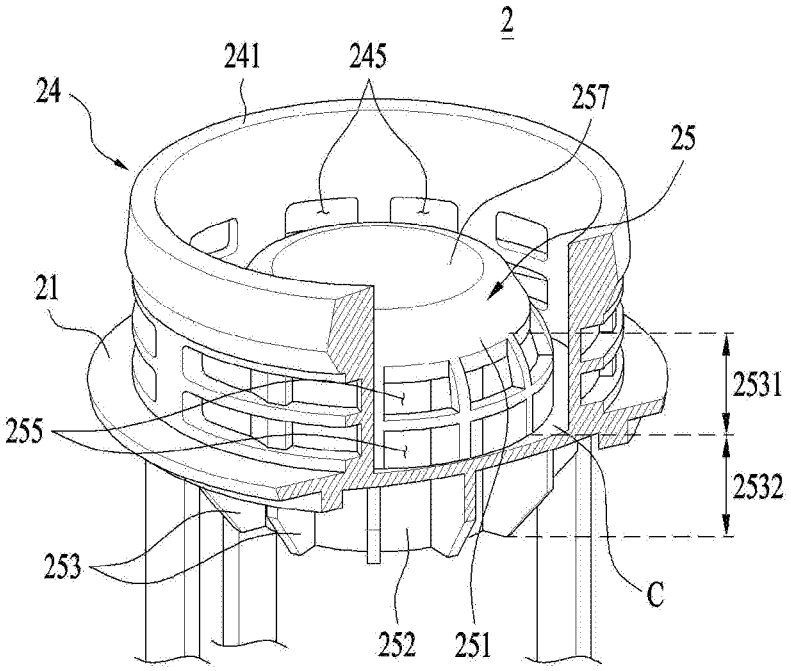
FIG. 5 is a perspective diagram partially cut away to show an internal space of the filter device shown in FIG. 4.
Figure 6:
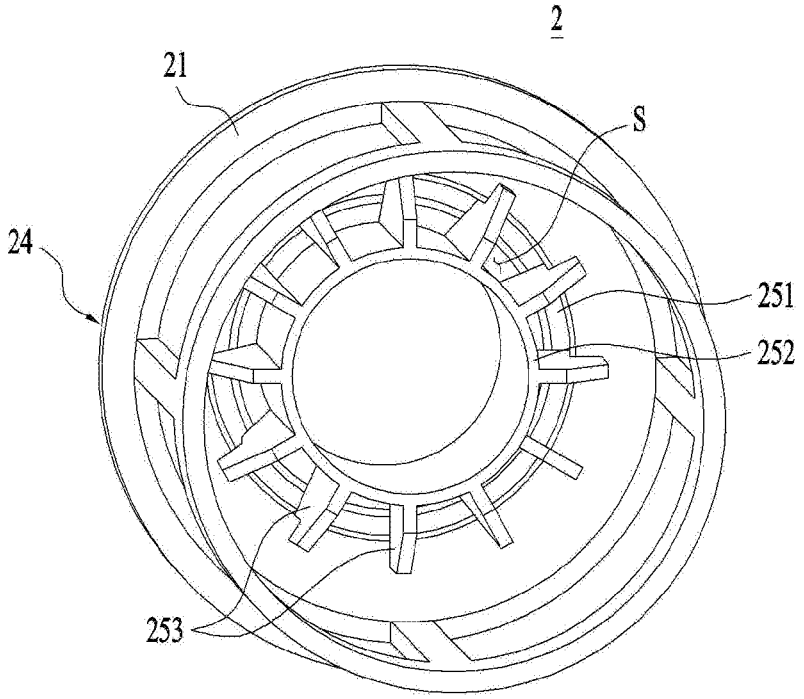
FIG. 6 is a perspective diagram of the filter device shown in FIG. 4, viewed from a lower side.
Figure 7:
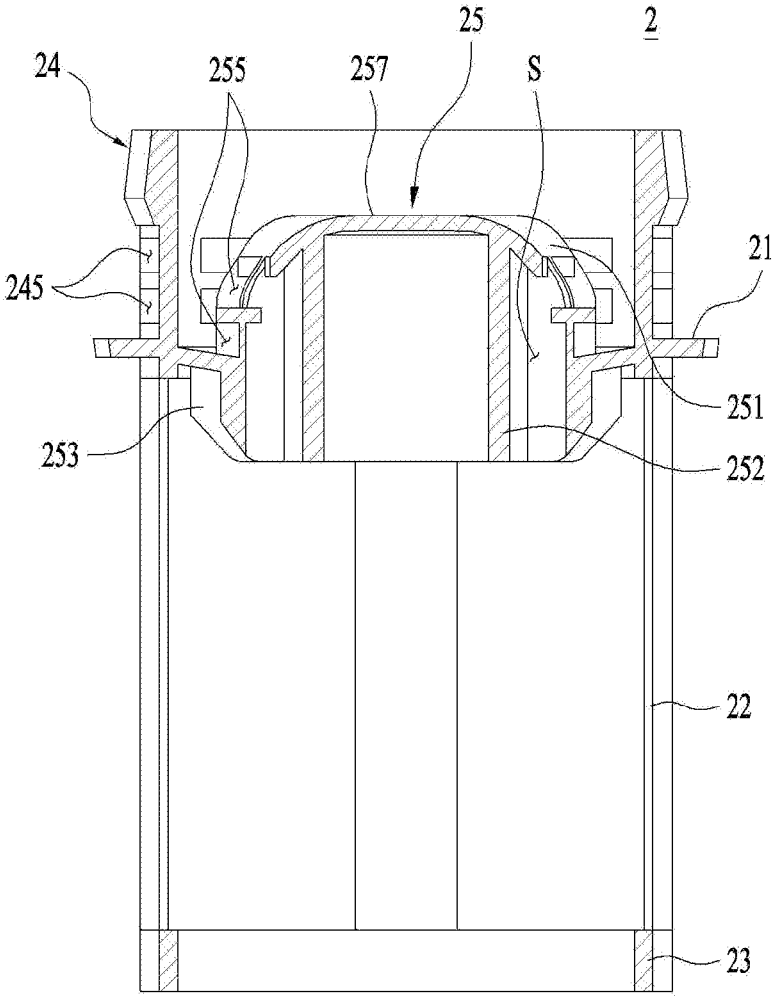
FIG. 7 is a sectional diagram illustrating the filter device shown in FIG. 4.

FIG. 4 is a perspective diagram illustrating a filter device in accordance with one embodiment of the present disclosure and FIG. 5 is a perspective diagram partially cut away to show an internal space of the filter device shown in FIG. 4. FIG. 6 is a perspective diagram of the filter device shown in FIG. 4, viewed from a lower side and FIG. 7 is a sectional diagram illustrating the filter device shown in FIG. 4.

Referring to FIGS. 4 through 7, the filter device 2 provided in the dishwasher 100 in accordance with the illustrated embodiment of the present disclosure may include a holder portion 21 held on an outer circumferential surface of the penetrating hole 153 provided in the support portion 151; a support rib 22 extended downwards from the holder portion 21 and to which a mesh member 26 is mounted; a supporter 23 connected to ends of the support rib 220 and keeping the shape of the mesh member 26; a first body 24 provided in an upper surface of the holder portion 21 and comprising a plurality of first holes 245; and a second body 25 arranged inside the first body 24 in a radial direction and comprising a plurality of second holes 255. In this instance, a top surface of the second body 25 may be lower than a top surface of the first body 24.

As one example, the first body 24 and the second body 25 may be integrally formed with the holder portion 21 in an injection molding process, which is shown in FIGS. 4 through 9.

As an alternative example, the first body 24 and the second body may be demountably secured to the holder portion 21. For example, the second body 25 may be integrally formed with the holder portion 21 and the first body 24 may be demountably secured to the holder portion 21 as an independent part, which is shown in FIGS. 10 through 16C.

Hereinafter, the example of the first body and the second body which are integrally formed with the holder portion 21 is described referring to FIGS. 4 through 9. The other example of the first body demountably secured to the holder portion 21 will be described later referring to FIGS. 10 through 16C.

The first body 24 may include a rim portion 241, a plurality of extended ribs 243 extended downwards to the holder portion 21 from the rim portion 241, and one or more reinforcing ribs 244 connecting the extended ribs 243 with each other. In this instance, the first holes 245 may be formed by the extended ribs 243 and the one or more reinforcing ribs 244 so that the plurality of the first holes 245 may be formed along a lateral circumferential surface of the first body 24.

Figure 11A:
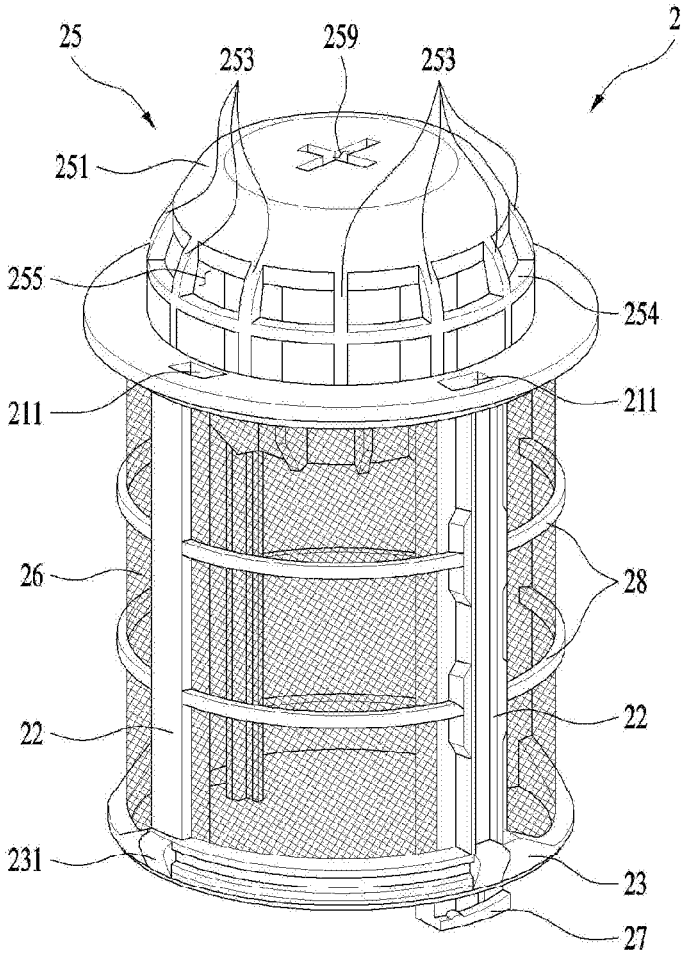
FIGS. 11A and 11B are exploded diagrams illustrating the filter device of FIG. 10.
Figure 11B:
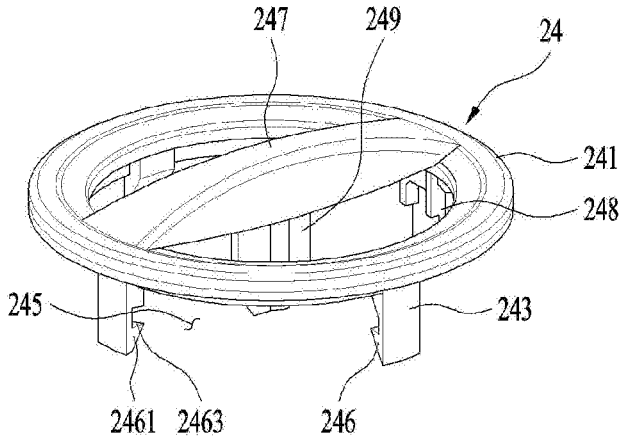

If necessary, the one or more reinforcing ribs 244 may be omitted (see FIG. 11B). In this instance, the plurality of the first holes 245 may be formed by the rim portion 241, the holder portion 21 and the extended ribs 243.

In the former example, the plurality of the first holes 245 has the horizontal length larger than the vertical length.

The plurality of the second holes 255 may be formed along the lateral circumferential surface of the second body 25. Washing water may flow into the filter device 2, passing through the first holes 245 and the second holes 255 sequentially, so that the filter device 2 can filter foreign substances in two steps.

At this time, the first holes 245 and the second holes 255 may be arranged distant from each other in the radial direction of the filter device 2. The surface of the first body 24 in which the first holes 245 are formed may be spaced apart a preset distance in a radial direction from the surface of the second body 25 in which the second holes 255 are formed.

In the illustrated example, the shape of the first hole may be different from that of the second hole 255 so that the filter device 2 can filter various-shaped foreign substances.

For example, the first hole 245 may be larger than the second hole 255. In other words, the cross section area of the first hole 245 may be larger than that of the second hole 255. The first holes 245 may filter relatively large-sized foreign substances and the second holes 255 may filter relatively small-sized foreign substances.

As another example, the first hole 245 may have the preset width (in other words, the length) which is larger than the height and the second hole 255 may have the preset width equal to the height. Even in this instance, the cross section area of the first hole 245 may be larger than that of the second hole 255. Accordingly, the first hole 245 may filter relatively large-sized foreign substances and the second holes 255 may filter relatively small-sized foreign substances.

In the illustrated example, the second body 25 may be dome-shaped and a flat portion 257 may be provided in an upper end of the second body 25. The plurality of the second holes 255 may be arranged in the lateral circumferential surface of the second body 25, except the flat portion 257.

The foreign substances falling to the top of the second body 25 (especially, stick-shaped foreign substances) may be blocked by the flat portion 257 and prevented from coming into the second body 25 directly.

Meanwhile, the second body 25 may include an external wall portion 251 and an internal wall portion 251. Specifically, the second body 25 may include the external wall portion 251 having the second holes 255 formed therein and the internal wall portion 252 vertically extended from a radial direction side of the external wall portion 251.

The internal wall portion 252 may be formed in a hollow cylinder shape. An outer lateral surface of the internal wall portion 252 may be distant from an inner lateral surface of the external wall portion 251, so that the stick-shaped foreign substances having passed the first holes 245 and the second holes 255 may be filtered by the internal wall portion 252.

A lower end of the internal wall portion 252 may be extended downwards to be lower than a lower end of the external wall portion 251 so that even the stick-shaped foreign substances obliquely coming through the first holes 245 and the second holes 255 may be filtered by the internal wall portion 252.

A plurality of ribs 253 may be projected outwards from the lateral circumferential surface of the internal wall portion 252 in a radial direction. For example, the plurality of the ribs 253 may be spaced apart a preset distance from each other along the lateral circumferential surface of the internal wall portion 252.

The plurality of the ribs 253 may be extended from the outer lateral surface of the internal wall portion 252 to an inner circumferential surface of the external wall portion 251. Accordingly, the stick-shaped foreign substances coming through the first holes 245 and the second holes 255 in a circumferential direction of the internal wall portion 252 may be filtered by the plurality of the ribs 253.

The internal wall portion 252 is arranged distant from the external wall portion 251 in an inner radial direction. A predetermined space (S) may be formed between the internal wall portion 252 and the external wall portion 251 and the washing water flows in the space (S) (see FIGS. 6 and 7).

At this time, each of the ribs 253 shuts off the paths along the circumference of the space (S) formed between the internal wall portion 252 and the external wall portion 251, only to prevent the washing water and foreign substances from flowing along an outer circumferential direction of the external wall portion 251.

In other words, all of the ribs 253 may be extended from the outer lateral surface of the internal wall portion 252 to an inner lateral surface of the external wall portion 251 to shut off the path along the circumferential direction of the space formed between the internal wall portion 252 and the external wall portion 251.

Accordingly, even stick-shaped foreign substances which might be drawn into the first holes 245 and the second holes 255 in any directions are filtered by the internal wall portion 252 and the ribs 253. Different from that, washing water may flow to the lower area of the filter device 2 via the first holes 245, the second holes 255 and the space (S).

Each of the ribs 253 may include a rib top 2532 arranged corresponding to the inner lateral surface of the external wall portion 251 and a rib bottom 2532 extended downwards from the rib top 2531. The rib top 2531 and the rib bottom 2532 may be integrally formed with each other.

It is preferred that the projected width of the rib bottom 2532 is larger than the projected width of the rib top 2531. In other words, the rib bottom 2532 may be projected higher than the rib top 2531.

The projected width of the rib top 2531 may be restricted by the radial-direction width of the external wall portion 251. In contrast, the rib bottom 2532 is located lower than the lower end of the external wall portion 251 and the projected width of the rib bottom 2532 is not restricted by the radial-direction width of the external wall portion 251.

The length (in other words, the vertical length) of the rib top 2531 is equal to the length (in other words, the vertical length) of the rib bottom 2532. The rib bottom 2532 may be extended more downwards than the lower end of the external wall portion 251 as far as the length of the rib top 2531.

The plurality of the ribs 253 may be extended in an overall area of the longitudinal direction of the internal wall portion 252. Accordingly, the stick-shaped foreign substances falling down via the first holes 243 and the second holes 255 in a direction getting farther from the internal wall portion 252 may be effectively filtered by the internal wall portion 252 and the rib bottom 2532.

As shown in FIG. 5, a connection portion (C) for connecting the first body 24 and the second body 25 with each other may be provided between an outer bottom circumference of the second body 25 and an inner circumference of the first body 24.

The holder portion 21 projected outwards in a radial direction of the first body 24 may be provided in the first body 24, corresponding to the connection portion (C). In other words, the holder portion 21 extended from the first body 24 along a circumferential direction of the first body may be provided under the first hole 245. The holder portion 21 is secured to the outer circumferential surface of the penetrating hole 153 to fix the filter device 2 to the sump cover 15.

The mesh member 26 may be mounted between the holder portion 21 and the supporter 23. In other words, the mesh member 26 may be provided along an internal circumferential surface of the support rib 22. The mesh member 26 may filter the fine foreign substances having passed all of the first and second holes 245 and 255.

Figure 8:
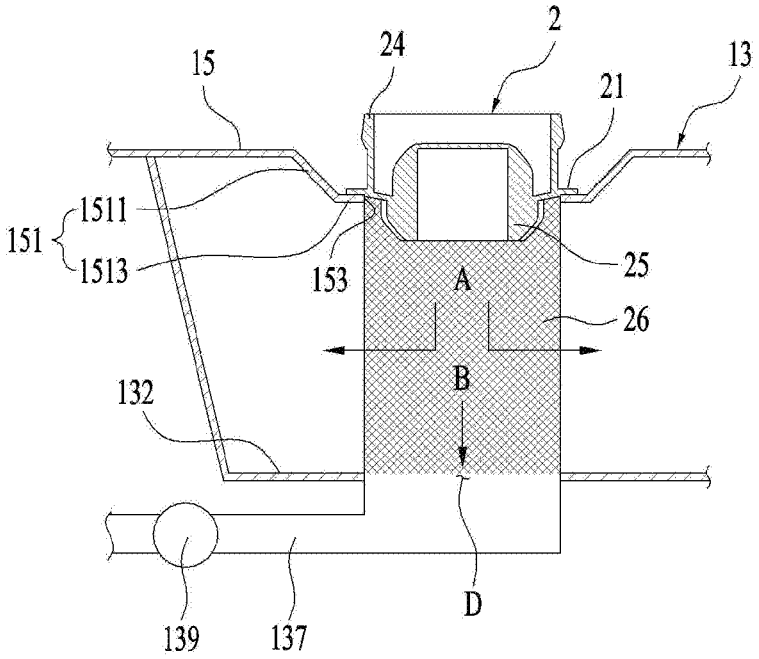
FIG. 8 is a diagram schematically illustrating the filter device of FIG. 4 which is mounted in a sump.

FIG. 8 is a diagram schematically illustrating the filter device of FIG. 4 which is mounted in a sump.

Referring to FIGS. 1 through 8, the support portion 151 may be coupled to the sump cover 15 and the penetrating hole 153 may be formed in the support portion 151. At this time, the sump cover 15 serves as the top surface of the sump 13. At least predetermined portion of the filter device 2 may be detachably inserted in the penetrating hole 153.

In the illustrated example, the support portion 151 includes an inclined portion 1511 inclined toward the penetrating hole 153 and a filter installation sheet 1513 provided adjacent to the penetrating hole 153. The washing water and foreign substances falling to the top surface of the sump 13 may be guided to the filter device 2 along the inclined portion 1511.

In detail, the holder portion 21 projected outwards in the radial direction of the first body 24 may be seated on the filter installing sheet 1513. The first holes 145 and the second holes 255 located over the holder portion 21 may be exposed to the filter installing sheet 1513. Accordingly, the washing water falling to the top surface of the sump 13 may be introduced into the filter device 2 via the first holes 245 and the second holes 255. During the process, foreign substances are filtered via the first holes 245 initially and the second holes 255 secondarily.

A drainage hole (D) may be formed in a bottom surface 132 of the sump 13 to drain the washing water held in the sump 13 and the foreign substances accommodated in the filter device.

Specifically, the lower end of the filter device 2 is openable and in communication with the drainage hole (D). When the filter device 2 is installed in the sump 13, the lower end of the filter device 2 is coupled to the bottom surface of the sump 13, in communication with the drainage hole (D). A drainage line 37 may be connected to the drainage hole (D) and a drainage pump 139 may be provided in the drainage line 137.

Hereinafter will be described the configuration for re-supplying the washing water inside the sump 13 to the sub after passing the filter device 2 (in other words, the circulation of washing water) and the configuration for draining the washing water inside the sump 13 and the foreign substances inside the filter device 2 (in other words, the drainage of washing water and foreign substances).

To circulate the washing water, the supply pump 8 is driven and the driving of the drainage pump 139 is stopped. That is, only the supply pump 8 has to be driven among the supply pump 8 and the drainage pump 139 so as to circulate the washing water.

Once the supply pump 8 is put into operation, the washing water falling to the top surface of the sump 13 may flow through the filter device 2 along a direction of an arrow "A" shown in FIG. 8. At this time, the fine foreign substances contained in the washing water flowing along the direction of the arrow "A" may be filtered by the mesh member 26.

The washing water having the fine foreign substances filtered by the mesh member may be re-supplied to the tub 11 by the supply pump 8 shown in FIG. 1.

To drain the washing water and foreign substances, the drainage pump 130 may be driven and the supply pump 8 may be stopped. That is, only the drainage pump 139 has to be driven among the supply pump 8 and the drainage pump 139 so as to drain the washing water and foreign substances.

Once the drainage pump 139 is put into operation, the foreign substances filtered by the mesh member 26 of the filter device 2 may be drained outside via the drainage line 137 together with the washing water inside the sump 13.

The fine foreign substances filtered by the mesh member 26 may flow along a direction of an arrow "B" shown in FIG. 8 together with the washing water. The washing water and the fine foreign substances may be exhausted outside by the driving of the drainage pump 139.

As mentioned above, thin long sick-shaped foreign substances are filtered by the filter device 2 only to prevent the drainage line 137 and entrance of the drainage pump 139 from getting clogged.

Figure 9:
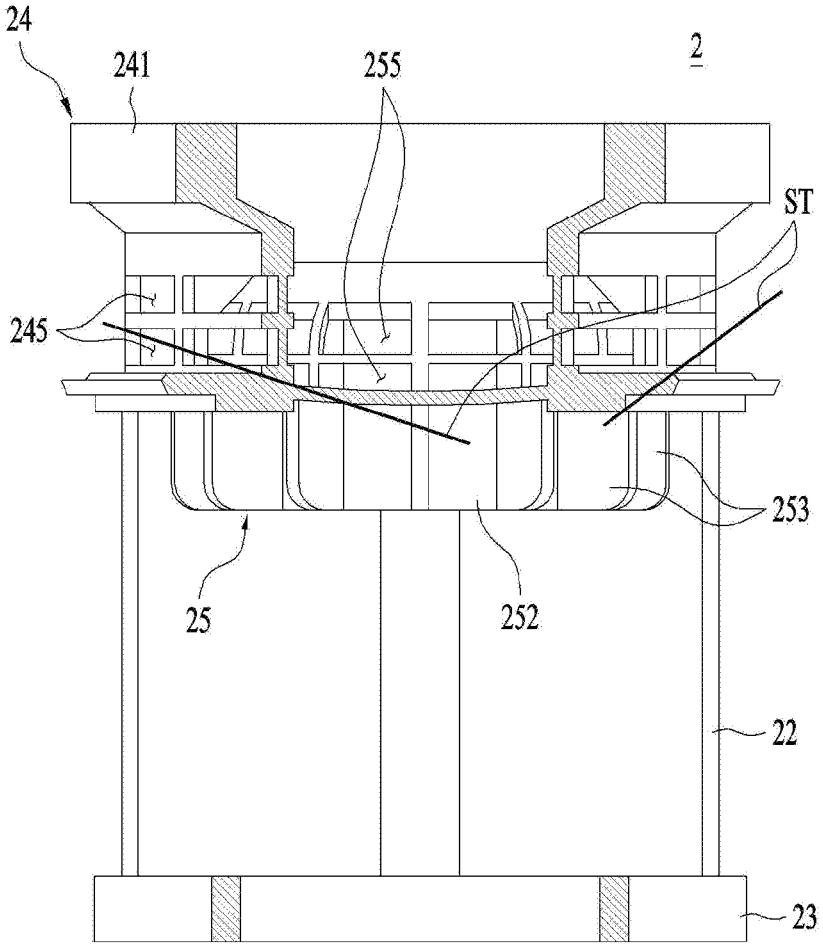
FIG. 9 is a diagram illustrating a principle for filtering stick-shaped foreign substances by using the filter device of FIG. 4.

Referring to FIG. 9, the principle of filtering stick-shaped foreign substances by using the filter device 2 will be described.

FIG. 9 is a diagram illustrating a principle for filtering stick-shaped foreign substances by using the filter device of FIG. 4.

Referring to FIG. 9, at least predetermined thin long stick-shaped foreign substances (ST) may be drawn into the filter device 2 via the first holes 245 and the second holes 255 formed in the filter device 2.

If the cylinder-shaped internal wall portion 252 and the plurality of the ribs 253 are not provided, the stick-shaped foreign substances (ST) are likely to be drawn into the first body 24 via the first hole 245 and the second hole 255. That is, the stick-shaped foreign substances (ST) could be drawn into the filter device 2 via the first hole 245 and the second hole 255.

The stick-shaped foreign substances (ST) drawn into the filter device 2 might clog the drainage line 137 and/or the entrance of the drainage pump 139 shown in FIG. 1 only to cause washing water flow error or drainage error.

However, according to the present disclosure, the stick-shaped foreign substances (ST) may be filtered by the cylinder-shaped internal wall portion 252 provided in the second body 25 and the plurality of the ribs 253 formed along the circumferential direction of the internal wall portion 252.

The washing water flow error and the drainage error caused by the stick-shaped foreign substances (ST) is able to be prevented by the internal wall portion 252 and the plurality of the ribs 253 formed along the circumferential direction of the internal wall portion 252.

Especially, the disadvantage of the clogged entrance of the drainage pump 139 or the blocked drainage line 137 by the stick-shaped foreign substances (ST) as shown in FIG. 1 can be solved according to the present disclosure and the drainage of washing water may be facilitated.

Hereinafter, referring to FIGS. 10 through 16C, a filter device provided in a dishwasher according to other embodiments of the present disclosure will be described. The filter device shown in FIGS. 10 through 16C is similar or equal to the filter device shown in FIGS. 4 through 9, except that the first body 24 is detachably secured to the holder portion 21. Regardless of numeral references, the same or equivalent components may be provided with the same reference numbers and description thereof will not be repeated.

Figure 10:
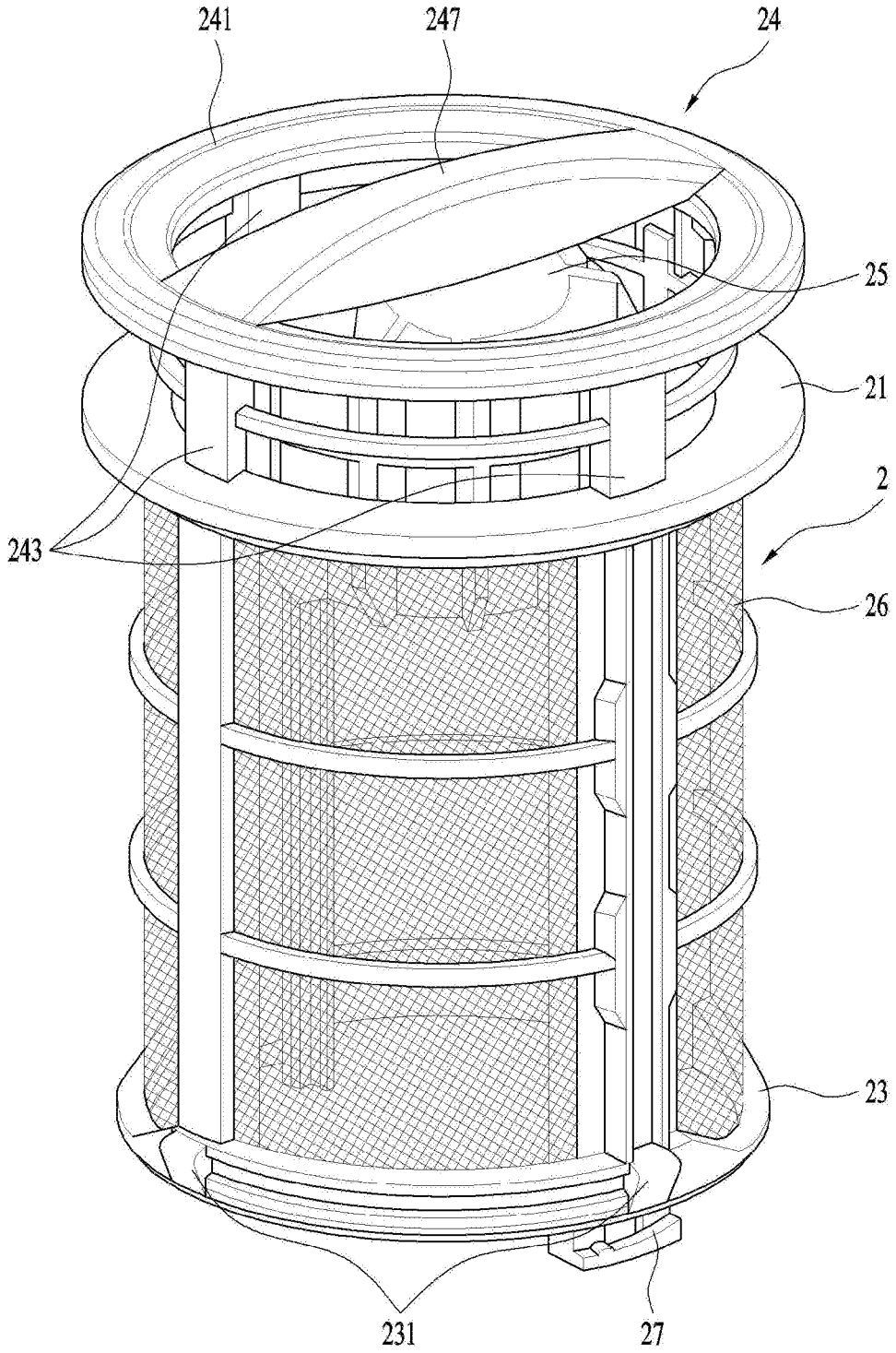
FIG. 10 is a perspective diagram illustrating a filter device in accordance with another embodiment of the present disclosure.
Figure 12:
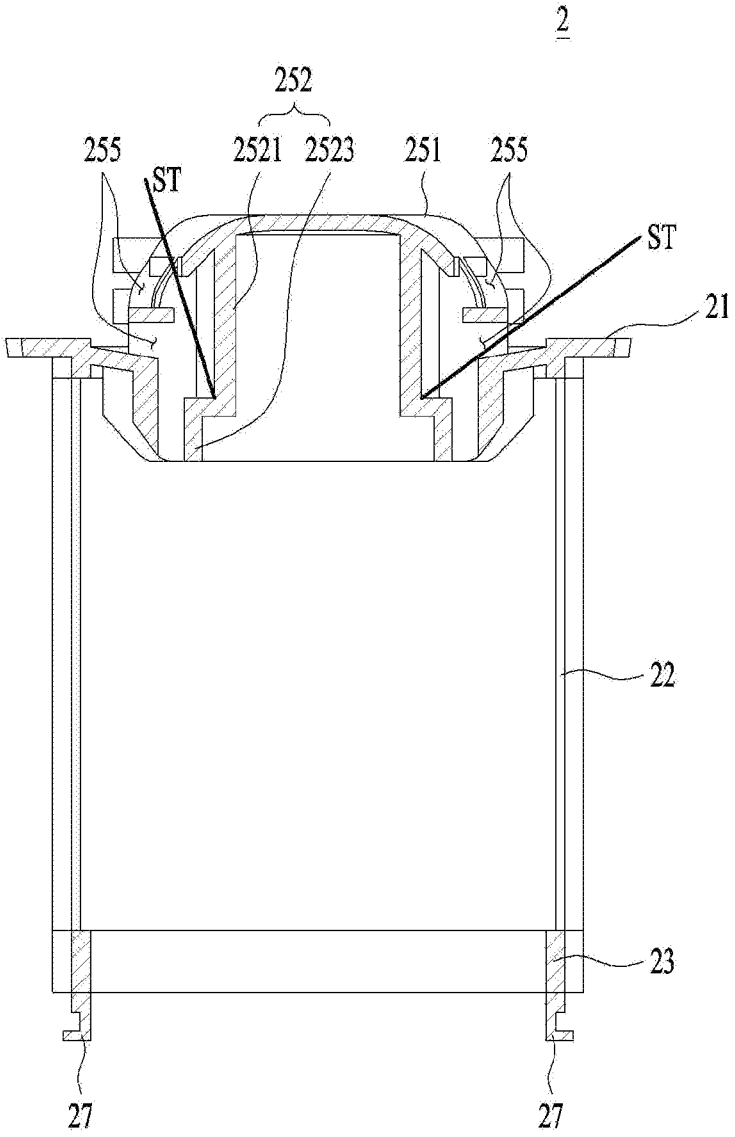
FIG. 12 is a sectional diagram illustrating the filter device of FIGS. 11A and 11B.

FIG. 10 is a perspective diagram illustrating a filter device in accordance with another embodiment of the present disclosure and FIGS. 11A and 11B are exploded diagrams illustrating the filter device of FIG. 10. FIG. 12 is a sectional diagram illustrating the filter device of FIGS. 11A and 11B.

Referring to FIGS. 10 through 12, the filter device 2 provided in the dishwasher 100 according to the illustrated embodiment of the present disclosure may include a holder portion 21 held on an outer circumferential surface of the penetrating hole 153 provided in the support portion 151; a support rib 22 extended downwards from the holder portion 21 and to which a mesh member 26 is mounted; a supporter 23 connected to ends of the support rib 220 and keeping the shape of the mesh member 26; a second body 25 provided in an upper surface of the holder portion 21 and comprising a plurality of second holes 255; and a first body 24 detachably arranged outwards in a radial direction of the second body 25 and comprising a plurality of first holes 245. In this instance, a top surface of the second body 25 may be lower than a top surface of the first body 24.

The first body 24 may be detachably secured to the holder portion 21 and comprise a handle 247 provided in a top surface. The handle 247 may be formed across an inner circumferential surface of the rim portion 241.

Specifically, the first body 24 may include the donut-shaped rim portion 241 located higher than the second body 25, a plurality of extended ribs 243 extended from the rim portion 241 downwards to be secured to the holder portion 21, a reinforcing rib 244 connecting the extended ribs 243 with each other, and a handle 247 across the rim portion 241.

If necessary, the reinforcing rib 244 may not be provided. For example, in case the reinforcing rib 244 is provided as shown in FIG. 10, the first hole 245 may be defined by the rim portion 241, the extended rib 243, the reinforcing rib 244 and the holder portion 21. As an alternative example, in case no reinforcing rib 244 is provided as shown in FIG. 11B, the first hole 245 may be defined by the rim portion 241, the extended rib 243 and the holder portion 21.

The extended rib 243 may connect a lower area of the rim portion 241 and an upper area of the holder portion 21. A plurality of extended ribs 243 may be provided in the rim portion 241. For example, four extended ribs 243 may be spaced 90 degrees apart from each other. The embodiments of the present disclosure may not be limited to the extended ribs 243 spaced 90 degrees apart from each other and more than one extended ribs may be provided.

The handle 247 is held by the user trying to take out the filter device 2 and able to facilitate the detaching process of the filter device 2.

Specifically, when taking out the filter device 2 from the sump 13, the user holds only the handle 247 and is able to take out the filter device 2.

Even in case the user has to rotate the filter device 2 to take out the filter device 2 secured to the sump 13 by using a fastening unit (27, see FIG. 10), the user may rotate only the handle 247 and then detach and take out the filter device 2 from the sump 13.

In detail, the filter device 2 is detached from the communication hole 14 and the communication hole 14 is provided in the top surface of the sump 13. It can be said that the filter device 2 is detached from the sump 13.

Even the user having smaller hands, especially, a child or a woman, than a general man is able to take out the filter device 2 from the sump 13, using the handle 247.

The grip strength needed to take out or rotate the filter device 2 from the sump 13 by holding the handle 247 may be weaker than the grip strength needed to take out or rotate the filter device by holding the overall top surface of the filter device 2. Accordingly, use convenience for taking out the filter device 2 may be maximized.

The area of the handle 247 is smaller than the overall area of the top surface of the filter device 2 so that the filter device 2 can be less exposed to foreign substances. Also, the handle 247 is exposed to the top of the filter device 2 and exposed to washing water consistently. Accordingly, the handle 247 may be kept clean enough to enhance the user's satisfaction.

In FIG. 10, the handle 247 is across the center of the rim 241. The position of the handle in accordance with the embodiments of the present disclosure is not limited thereto. For example, the handle 247 formed in a cross shape may be provided in the rim portion 241 and the plurality of the cross-shaped handle 247 may be provided.

The handle 247 may be also provided in the filter device 2 shown in FIG. 4. In other words, the first body 24 having the handle 247 may be integrally formed with the holder portion 21. However, it is more advantageous that the first body 24 is detachably provided, considering foreign-substances filtering capacity, presence of interference in internal components of the tub 11, availability of ongoing management and maintenance and rise of mold manufacture cost caused by complex appearance. Hereinafter, only the case is be described that the first body 24 including the handle 247 is detachably secured to the holder portion 21.

As shown in FIG. 11B, a hook 246 configured to be coupled to the holder portion 21 is provided in an end of the extended rib 243 and an insert hole 211 is penetrated in the holder portion 21 to insert the hook 246 therein. The number of the insert hole 211 may be equal to the number of the extended ribs 243.

The hook 246 may include an inclined surface 2461 inclined toward a direction to the center of the rim portion 241 from a lower end of the extended rib, and a hook surface 2463 extended from one end of the inclined surface 2461 to an inner surface of the extended rib 243.

Accordingly, the hook 246 of the extended rib 243 is inserted in the insert hole 211 of the holder portion 21 and the hook surface 2463 of the hook 246 is then fixed to the lower surface of the holder portion 241.

In the illustrated embodiment, the extended rib 243 may further include a fixing portion 248 projected from the rim portion 241 downwards and spaced apart from the hook surface 2463 of the hook 246.

The fixing portion 248 is in close contact with the upper surface of the holder portion 21 to fix the first body 24 to the holder portion 21. In other words, even with the vibration of tub 11, the rotational vibration of injection arms 3 and 5 or the pressure of washing water, the first body 24 may be stably coupled to the holder portion 21.

The fixing portion 248 may keep a uniform distance between the holder portion 21 and the rim portion 241. At this time, the fixing portion 248 and the hook 246 is corresponding to the thickness of the holder portion 21.

In example embodiments, a guide rib 249 may be formed under the handle 247 of the first body 24, and the guide rib 249 may be inserted in a guide hole 259 formed in the flat portion 257 of the second body 25.

While getting inserted in the guide hole 259, the guide rib 249 may guide the extended rib 243 to get inserted in the insert hole 211. In other words, the guide rib 249 and the guide hole 259 may guide the coupling process of the first body 24 and the holder portion 21.

For example, the guide rib 249 may be formed in a cross shape and the guide hole 259 may be formed in a corresponding shape to the guide rib 249.

As shown in FIG. 12, the second body 25 may include an external wall portion 251 having a second hole 255 formed therein; an internal wall portion 252 extended from the external wall portion 251 in a radial direction vertically; a plurality of ribs projected from an outer circumferential surface of the internal wall portion 252 in a radial direction; one or more reinforcing rib 254 connecting the ribs 253 with each other; and a flat portion 253 provided in a top surface of the external wall portion 251. The second hole 255 may filter the foreign substances contained in washing water.

The internal wall portion 252 may include a first internal wall body 2521 projected from a flat surface parallel with the holder portion 21 vertically at the same time; and a second internal wall body 2523 extended from a lower end of the first internal wall body 2521 in an inner circumferential surface of the holder portion 21, forming a step with the first internal wall body 2521.

In this instance, even the stick-shaped foreign substances (ST) coming into the filter device 2 after failing to be filtered by the second hole 255 may be caught in the step formed by the first and second internal wall body 2521 and 2523 and prevented from getting into the sump 13.

A support rib 22 may be extended from the holder portion 21 toward the supporter 23. The support rib 22 may support the mesh member 26 to keep the circular shape.

The plurality of the support ribs 22 may be connected with each other by a reinforcing ring 215. One or more reinforcing rings 215 may be provided between the holder portion 21 and the supporter 23.

The fastening unit 27 may be provided in a lower end of the supporter 23.

A screw unit 17 may be provided in an inner surface of the sump 13 (See FIG. 1) and the fastening portion 27 may be fastened to the screw unit 17. Specifically, the user inserts the filter device 2 in the communication hole 14 and rotates the filter device to fasten the fastening portion 27 to the screw unit 17. Accordingly, the filter device 2 may be secured to the sump 13 stably. At this time, the user may rotate the filter device 2 smoothly and easily, using the handle 247 of the first body 24.

Figure 13A:
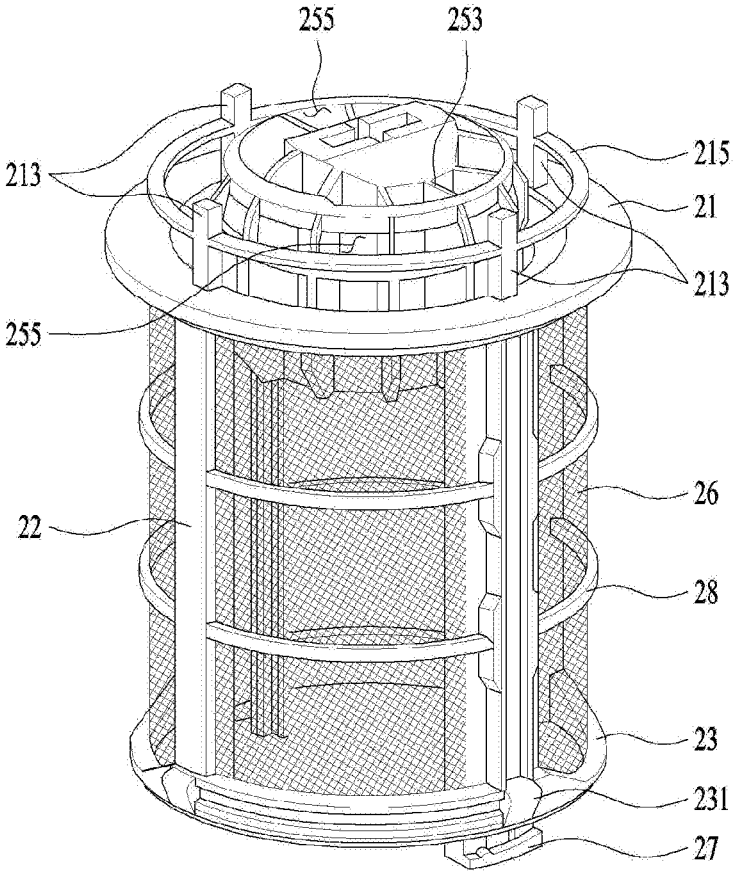
FIGS. 13A and 13B are exploded diagrams illustrating a filter device in accordance with a still further embodiment of the present disclosure.
Figure 13B:
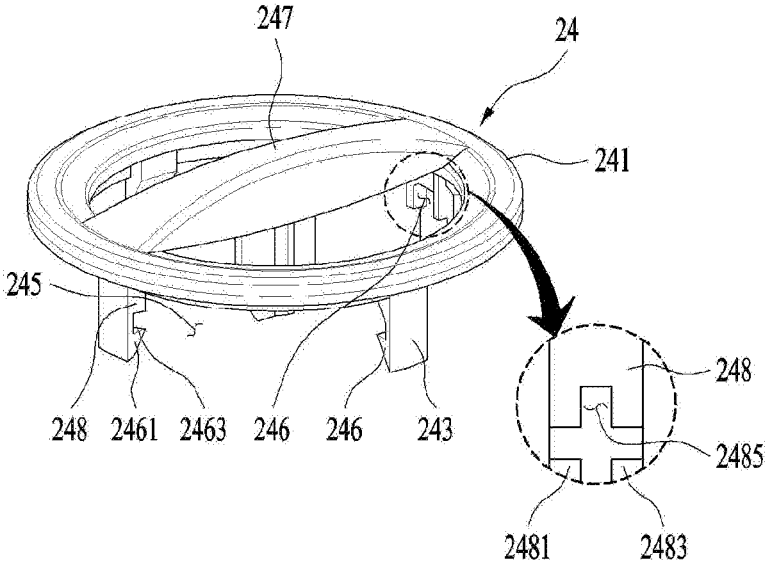

Hereinafter, the filter device provided in the dishwasher in accordance with still further embodiments of the present disclosure referring to FIGS. 13A and 13B. The filter device shown in FIGS. 13A and 13B is similar or equal to the filter device shown in FIGS. 11A to 12, except that the first body 24 is detachably secured to the top surface of the holder portion 21. Regardless of numeral references, the same or equivalent components may be provided with the same reference numbers and description thereof will not be repeated.

FIGS. 13A and 13B are exploded diagrams illustrating a filter device in accordance with a still further embodiment of the present disclosure.

Referring to FIG. 13A, the holder portion 21 of the filter device 2 may include a plurality of projected ribs 213 projected upwards along a circumferential direction of the holder portion 21; and a coupling ring 215 connecting the projected ribs 213 with each other.

At this time, the coupling ring 215 may be provided between the top surface of the holder portion 21 and ends of the projected ribs 213. The coupling ring 215 may reinforce the rigidity of projected ribs 213.

The extended ribs 243 of the first body 24 are able to be decoupled from the coupling ring 215. In the illustrated embodiment of the filter device 2 shown in FIG. 11B, the extended ribs 243 are insertedly secured to the insert holes 211 penetrating the holder portion 21. In the filter device 2 shown in FIG. 13B, the extended ribs 243 are coupled to the coupling ring 215 spaced apart from the top surface of the holder portion 21.

As shown in FIG. 13B, the hook 246 of the extended ring 243 is coupled to the coupling ring 215 and the fixing portion 248 is able to contact with an upper surface of the coupling ring 215. Specifically, the hook surface 2463 of the hook 246 contacts with a lower surface of the coupling ring 215 and a lower surface of the fixing portion 248 contacts with an upper surface of the coupling ring 215, so as to couple the first body 24 to the coupling ring 215 stably. Accordingly, the distance between the hook surface 2463 and the fixing portion 248 may be substantially equal to the thickness of the coupling ring 215.

In one embodiment, the hook 246 may include a first hook 2481 provided in a side of one end of the extended rib 243; and a second hook 2483 provided in the other side of the end, spaced from the first hook 2481 as far as the thickness of the projected rib 213.

While a predetermined area of the projected rib 213 is inserted between the first hook 2481 and the second hook 2483, the hook surfaces 2463 of the first and second hooks 2481 and 2483 may be coupled to the coupling ring 215. In this instance, the distance between the first hook 2481 and the second hook 2483 may be substantially equal to the thickness of the projected rib 213.

The vertical movement of first body 24 is restricted by the coupling ring 215 and the hook 246 and the horizontal movement may be restricted by the projected rib 213 and the hook 246. Accordingly, the first body 24 may be coupled to the coupling ring 215 stably and the filter device 2 may be also rotated together with the handle 247, when the user rotates the handle 247.

In one embodiment, the fixing portion 248 may further include a fixing groove 2485 accommodating one end of the projected rib 213.

When the projected rib 213 is inserted between the first hook 2481 and the second hook 2482, the end of the projected rib 213 may be inserted in the fixing groove 2485. Accordingly, the securing between the extended rib 254 and the projected rib 213 is able to become stronger.

Hereinafter, the process of taking out the filter device from the dishwasher will be described in detail referring to FIGS. 14A through 16C.

Figure 14A:
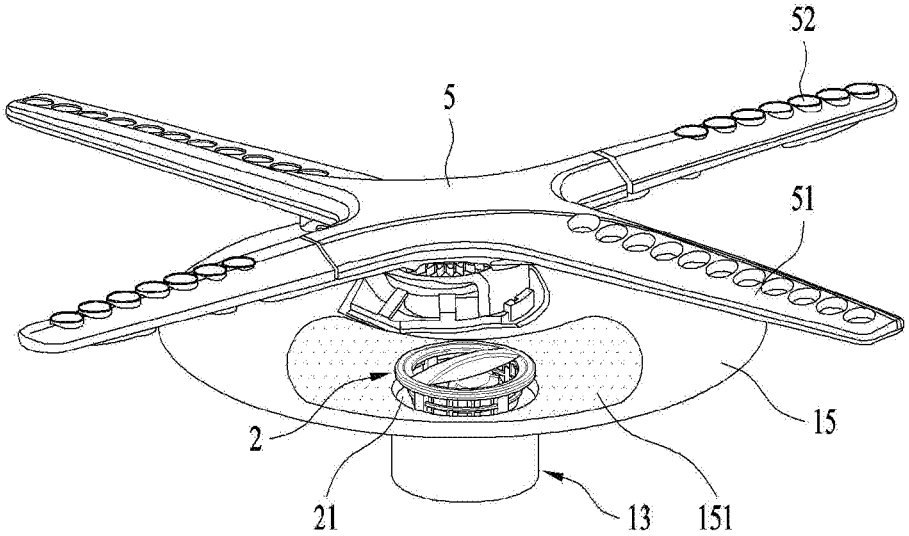
FIGS. 14A and 14B are diagrams illustrating a process of detaching a filter device from a conventional dishwasher.
Figure 14B:
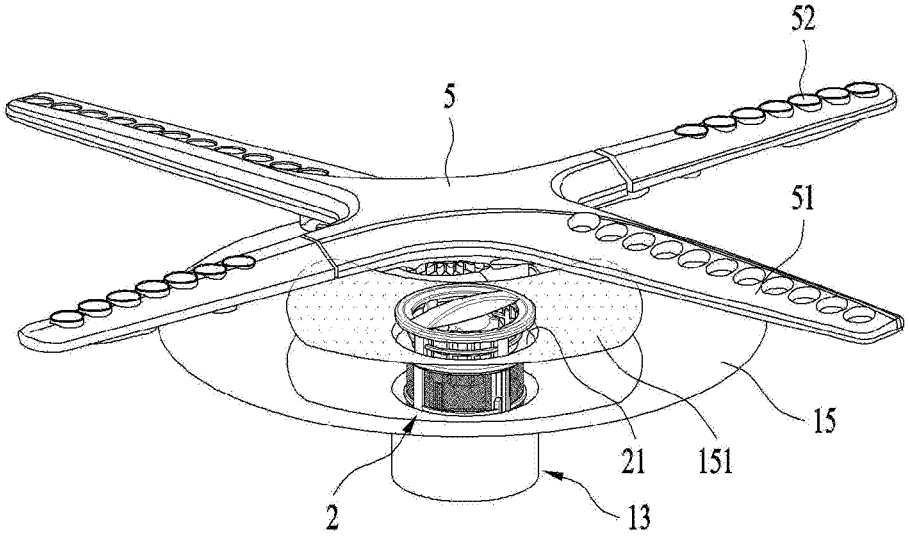
Figure 15A:
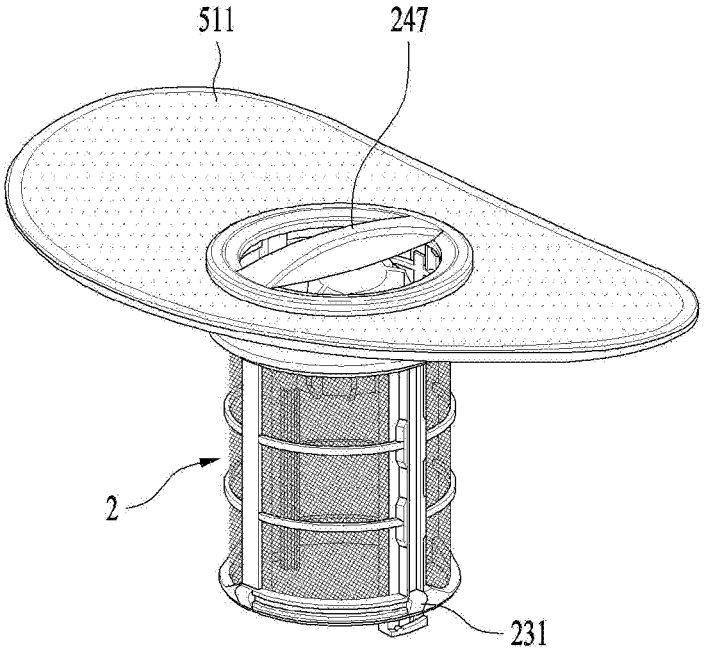
FIGS. 15A and 15B are diagrams illustrating a process of detaching the filter device in accordance with the embodiments of the present disclosure from the dishwasher.
Figure 15B:
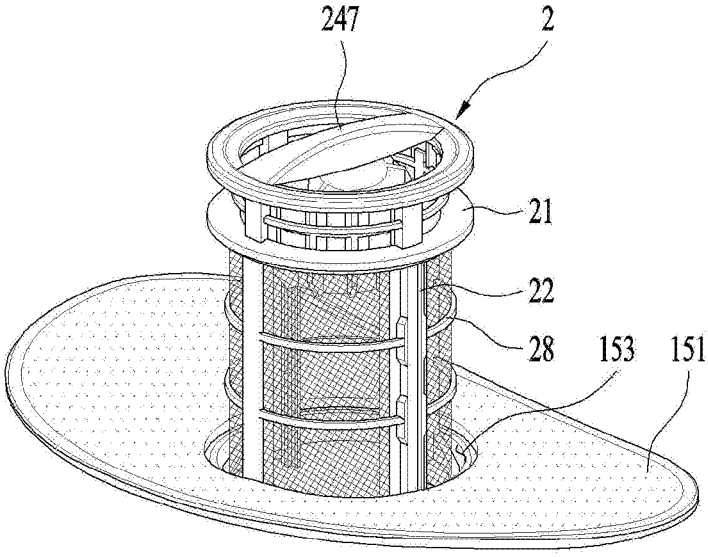
Figure 16A:
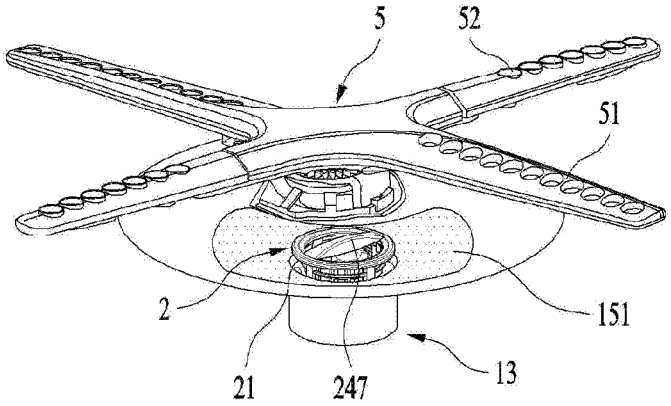
FIGS. 16A to 16C are diagrams illustrating a process of detaching the filter device of FIGS. 15A and 15B from the dishwasher.
Figure 16B:
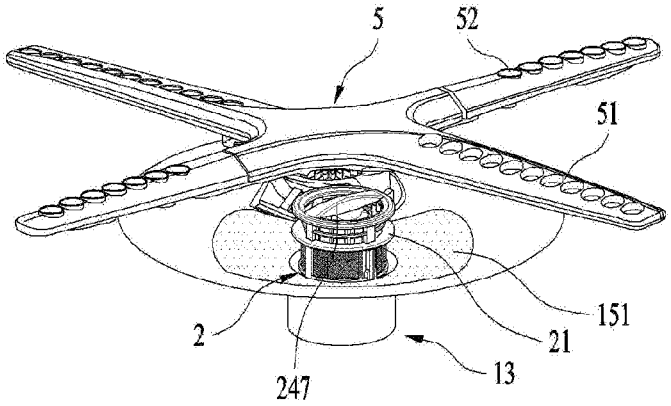
Figure 16C:
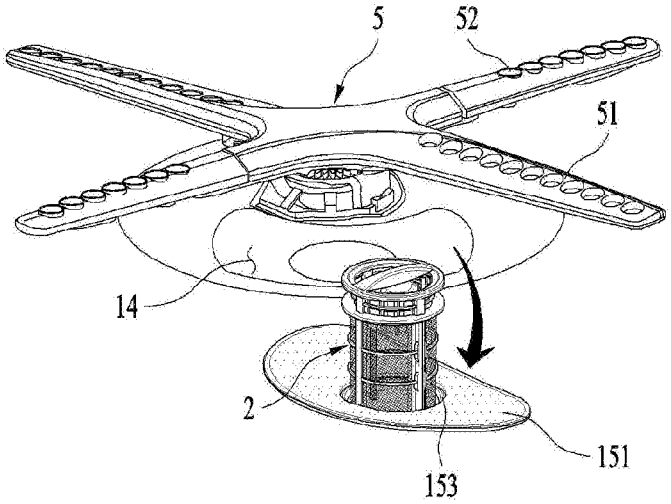

FIGS. 14A and 14B are diagrams illustrating a process of detaching a filter device from a conventional dishwasher and FIGS. 15A and 15B are diagrams illustrating a process of detaching the filter device in accordance with the embodiments of the present disclosure from the dishwasher. FIGS. 16A to 16C are diagrams illustrating a process of detaching the filter device of FIGS. 15A and 15B from the dishwasher.

Referring to FIGS. 14A and 14B, the support portion 151 provided in the sump cover 15 is secured to the holder portion 21 in the filter device 2 of the conventional dishwasher. At this time, the holder 21 and the support portion 151 are integrally formed with each other. When the user takes out the filter device 2 from the sump cover 15, the support portion 151 is taken out together with the filter device 2.

However, the support portion 151 typically occupies one fourth or more of the overall area of the sump cover area. When it is taken out together with the filter device 2, the support portion 151 is likely to be caught by the lower side of the injection arms 51 and 52 coupled to the sump cover 15.

Especially, the distance between the injection arms 51 and 52 is narrow in the structure of four injection arms (hereinafter, "quad arms") and both ends of the support portion 151 are more likely to get caught by the lower side of the injection arm 51 and 52.

Accordingly, the user has to rotate the injection arms 51 and 52 horizontally or change the location and profile of the support portion 151 inconveniently, when taking out the filter device 2 from the sump cover 15.

There would be projected or sharp areas in the injection arms 51 and 52 and the support portion 151 so that the user might get injury during the filter device withdrawing process.

If the filter device 2 is separated from the support portion 151, not coupled to the support portion 151, the user takes out the filter device 2 from the sump cover 15 and then the support portion from the sump cover 15 additionally and inconveniently.

FIGS. 15A and 15B illustrates one embodiment to solve that disadvantage and in the illustrated embodiment, a protrusion 231 is provided in the lower portion of the filter device 2.

FIGS. 15A and 15B illustrate only the filter device 2 and the support portion 151 which are provided in the dishwasher 100. Specifically, FIG. 15A illustrates the filter device completely inserted in the sump cover and FIG. 15B illustrates the protrusion 231 which contacts with the support portion 151 once the filter device 2 is taken out from the sump cover 15. At this time, the support portion 151 is insertedly secured to the communication hole 14 of the sump cover 15.

Referring to FIGS. 15A and 15B, the filter device 2 may include one or more protrusions 231 projected from an outer circumferential surface of the supporter 23.

In this instance, the protrusion 231 may be provided along one surface of the support rib 22. It is possible to arrange the protrusion 231 in any place of the upper and lower ends of the support rib 22. In case of being provided in the lower end of the support rib 22, it can be said that the protrusion 231 is provided in an outer circumferential surface of the supporter 23.

Meanwhile, the holder portion 21 is only seated on an inner circumferential surface of the penetrating hole 153 but not coupled to the support portion 151. Accordingly, some part of the filter device 2 may be detached from the sump cover 15 independently.

Once the filter device 2 is taken out from the sump cover 15 properly, the upper surface of the protrusion 231 may contact with an inner circumferential surface of the penetrating hole 153 formed in the support portion 151. The protrusion 231 may support the support portion 151. The support portion 151 may be caught by the protrusion 231 may be detached from the sump cover 15 together with the filter device 2.

Referring to FIGS. 16A to 16C, the process of taking out the filter device 2 will be described in detail.

Referring to FIG. 16A, the filter device 2 is inserted in the sump cover 15 and the holder portion 21 of the filter device 2 is insertedly seated on the inner circumferential surface of the penetrating hole 153 formed in the support portion 151.

Referring to FIG. 16B, when the user starts the filter device 2 from the sump cover 15, using the handle 247, the support portion 151 is still insertedly seated on the sump cover 15.

Referring to FIG. 16C, when the user completely takes out the filter device 2 from the sump cover 15, using the handle 247, the protrusion 231 contacts with the inner circumferential surface of the penetrating hole 153 and the support portion 151 rises together with the filter device 2 to be taken out from the sump cover 15.

After that, the only thing the user has to do is taking out the filter device 2 from the sump cover 15 and the support portion 151 is also detached from the sump cover 15 naturally.

Accordingly, the user is able to take out the filter device 2 from the sump cover 15 smoothly and easily. When taking out the support portion 151, the user may perform the process smoothly without the interference of the injection arms 51 and 52.

The user may demount the filter device 2 and the support portion 151 from the sump cover 15 smoothly and mount them to the sump cover 15 again after removing foreign substances.

Meanwhile, if the cross section area of the protrusion 231 is triangle-shaped, the user may detachably take out the filter device 2 from the support portion 151 easily.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A dishwasher comprising:

a tub defining a washing space;

a sump configured to collect wash water injected into the tub;

a supply pump configured to supply the wash water stored in the sump to the tub; and a filter located in the sump, the filter comprising:

a first body having a plurality of first holes located along a lateral circumferential surface of the first body; and a second body arranged at a radially inner side of the first body and having a plurality of second holes located along a lateral circumferential surface of the second body, wherein the first body is detachably secured radially outwards of the second body, and wherein the second body comprises an external wall portion where the second holes are located, and an internal wall portion positioned at a radially inner side of the external wall portion and extending vertically.

2. The dishwasher of claim 1, further comprising:

a sump cover configured to partition off the tub from the sump and to allow the tub to fluidly communicate with the sump; and a support portion detachably secured to a communication hole and comprising a penetrating hole.

3. The dishwasher of claim 2, wherein the second body further comprises:

a holder portion configured to be in contact with an outer circumferential surface of the penetrating hole and to support the first body;

a support rib extending downwards from the holder portion;

a mesh member coupled to the support rib; and a supporter provided at a lower end of the support rib and configured to maintain a shape of the mesh member.

4. The dishwasher of claim 3, wherein one or more protrusions project from the support rib, and the one or more protrusions are configured to come in contact with the support portion based on the filter being taken out from the sump cover.

5. The dishwasher of claim 3, wherein the internal wall portion comprises:

a first internal wall body extending vertically; and a second internal wall body extending from a lower end of the first internal wall body, the second internal wall body defining a step with the first internal wall body.

6. The dishwasher of claim 3, wherein an insert hole is provided in the holder portion, and wherein the first body further comprises an extended rib extending downwards and configured to insert into the insert hole.

7. The dishwasher of claim 6, wherein the extended rib comprises a hook configured to detachably secure the extended rib within the insert hole.

8. The dishwasher of claim 7, wherein the hook comprises:

an inclined surface inclinedly projecting from one end of the extended rib; and a hook surface extending from one end of the inclined surface to a surface of the extended rib.

9. The dishwasher of claim 8, wherein the extended rib further comprises a fixing portion extending downwards along one surface of the extended rib and leaving a gap between the fixing portion and the hook, and wherein the fixing portion is configured to keep a uniform distance between a top surface of the first body and the holder portion based on the extended rib being inserted in the insert hole.

10. The dishwasher of claim 3, wherein the second body further comprises:

a plurality of projected ribs extending upwards from the holder portion along a circumference thereof; and a coupling ring connecting the plurality of the projected ribs to each other, wherein the first body further comprises an extended rib extending downwards and configured to couple to the coupling ring, and wherein the extended rib comprises a hook configured to detachably secure the extended rib to the coupling ring.

11. The dishwasher of claim 10, wherein the extended rib further comprises a fixing portion extending downwards along one surface of the extended rib and leaving a gap between the fixing portion and the hook, and wherein, based on the hook being coupled to the coupling ring, a lower surface of the fixing portion is configured to contact an upper surface of the coupling ring and the hook is configured to contact a lower surface of the fixing portion.

12. The dishwasher of claim 11, wherein the hook comprises:

a first hook provided at a first side of one end of the extended rib; and a second hook provided at a second side of the one end of the extended rib, the first side and the second side facing each other, wherein the first hook and the second hook are separated by a thickness of the projected rib to accommodate the projected rib.

13. The dishwasher of claim 12, wherein the fixing portion further comprises a fixing groove configured to accommodate the projected rib, wherein one end of the projected rib is accommodated by the fixing groove based on the projected rib being inserted between the first hook and the second hook.

14. The dishwasher of claim 3, further comprising:

a fastening unit projecting downwards from the supporter; and a screw unit located at the sump, wherein the fastening unit is configured to fasten to or unfasten from the screw unit in response to user rotation of a handle of the first body when the filter is inserted in the sump.

15. The dishwasher of claim 2, wherein the support portion is a mesh type support portion configured to filter foreign substances drawn into the communication hole.

16. The dishwasher of claim 1, wherein the first body further comprises a guide rib extending downwards from a handle of the first body, and wherein the second body further comprises a guide hole located on a top surface of the second body, the guide hole being configured to receive the guide rib.

17. The dishwasher of claim 3, wherein the holder portion is configured to be supported by the outer circumferential surface of the penetrating hole.

18. The dishwasher of claim 1, wherein the first body further comprises a handle arranged across a top surface of the first body.

* * * * *